US007988469B1

(12) United States Patent
Sun et al.

(10) Patent No.: US 7,988,469 B1
(45) Date of Patent: Aug. 2, 2011

(54) UNIVERSAL SERIAL BUS ADAPTER

(75) Inventors: Zheng-Heng Sun, Taipei Hsien (TW); Lei Liu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/916,599

(22) Filed: Oct. 31, 2010

(30) Foreign Application Priority Data

Oct. 15, 2010 (CN) ..... 2010 1 0510030

(51) Int. Cl.
*H01R 13/44* (2006.01)

(52) U.S. Cl. ..... 439/140; 439/638

(58) Field of Classification Search ..... 439/140, 439/141, 638, 640
See application file for complete search history.

(56) References Cited

U.S. PATENT DOCUMENTS

| | | | | |
|---|---|---|---|---|
| 7,740,492 | B2 * | 6/2010 | Dei Rossi et al. | 439/131 |
| 7,833,029 | B2 * | 11/2010 | Choi et al. | 439/135 |
| 7,901,223 | B2 * | 3/2011 | Braunlich et al. | 439/135 |
| 2009/0124129 | A1 * | 5/2009 | Moshayedi | 439/638 |
| 2010/0233912 | A1 * | 9/2010 | Chiang | 439/638 |

* cited by examiner

*Primary Examiner* — Hien Vu
(74) *Attorney, Agent, or Firm* — Zhigang Ma

(57) ABSTRACT

A universal serial bus adapter includes an adapter board, a sliding element, a receiving cover, and a pivoting element. The adapter board includes a main board, a golden finger board extending from an end of the main board, and a number of signal pins arranged on the main board. The golden finger board includes a number of golden fingers attached on the golden finger board and correspondingly electrically connected to the signal pins. The sliding element includes a main body slidably mounted to the signal pins. The receiving cover is operable to receive the main board and the main body, with the golden finger board exposed outside of the receiving cover. The pivoting element includes a board pivotally mounted on the receiving cover.

5 Claims, 9 Drawing Sheets

UNIVERSAL SERIAL BUS ADAPTER

BACKGROUND

1. Technical Field

The present disclosure relates to a universal serial bus (USB) adapter.

2. Description of Related Art

USB interfaces, as shown in FIG. 1, can present in configurations such as a male USB header 10, a female USB header 20, a female USB A connector 30, and a male USB A connector 40. For connecting different USB interfaces, a USB adapter is needed. However, a common USB adapter can only communicate between two different kinds of USB interfaces, but not between any two of more than two different kinds of USB interfaces. Therefore there is room for improvement in the art.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
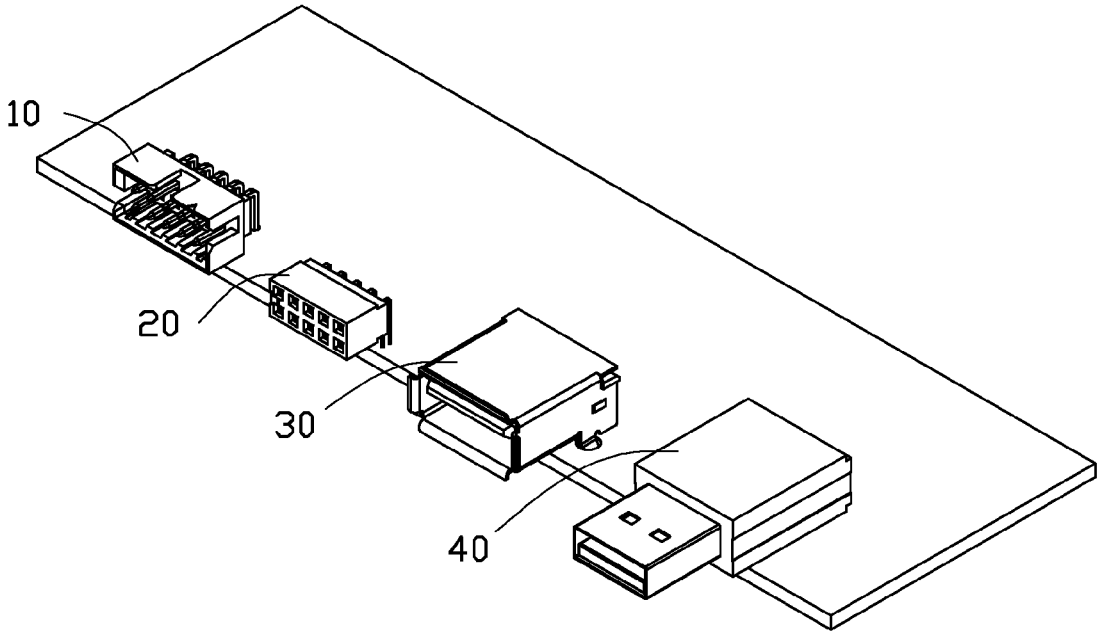
FIG. 1 (RELATED ART)
FIG. 1 is an isometric, schematic view of four kinds of common universal serial bus (USB) interfaces mounted on a board.
Figure 2:
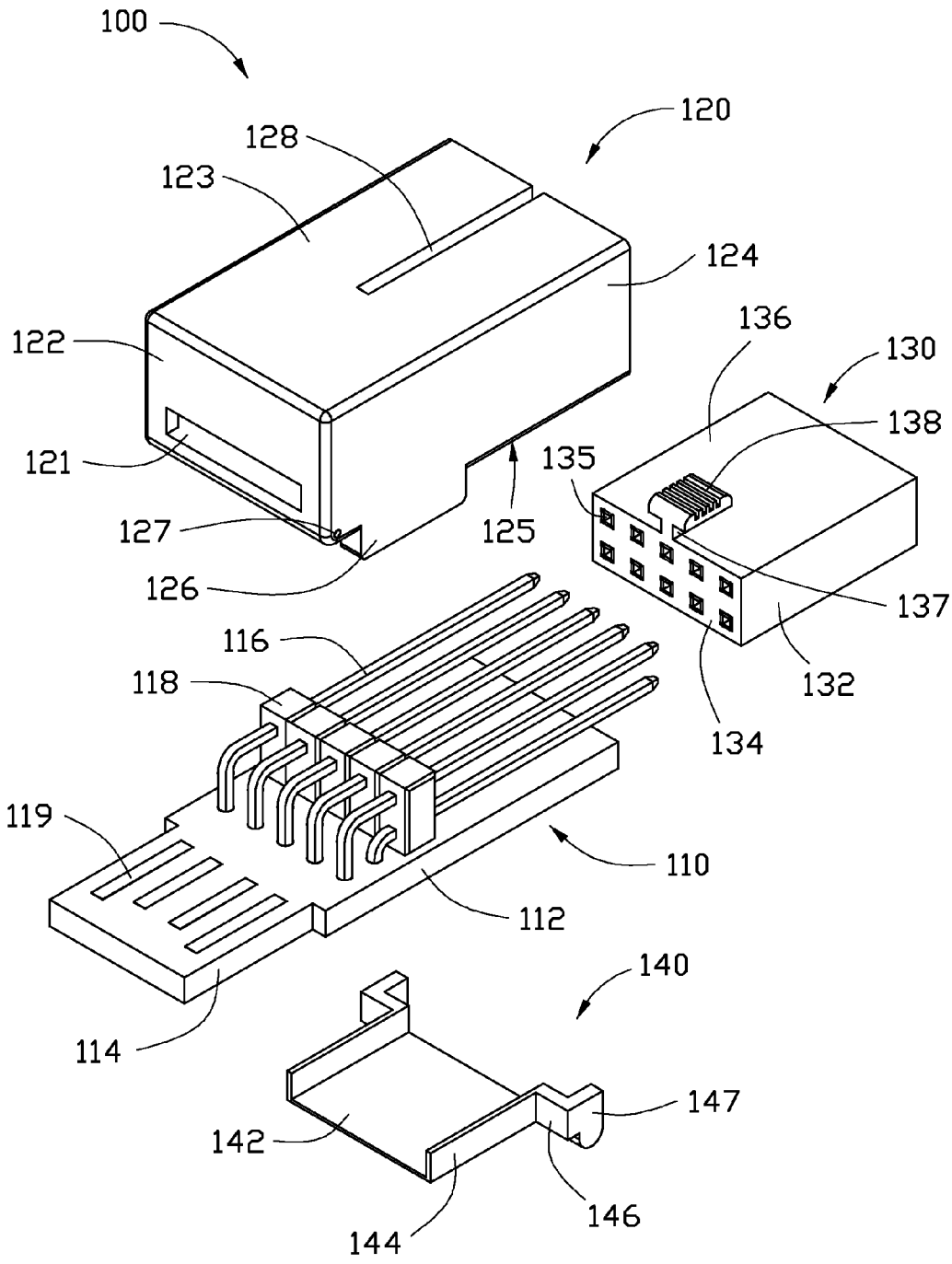
FIG. 2 is an exploded, isometric view of an embodiment of a USB adapter.
Figure 3:
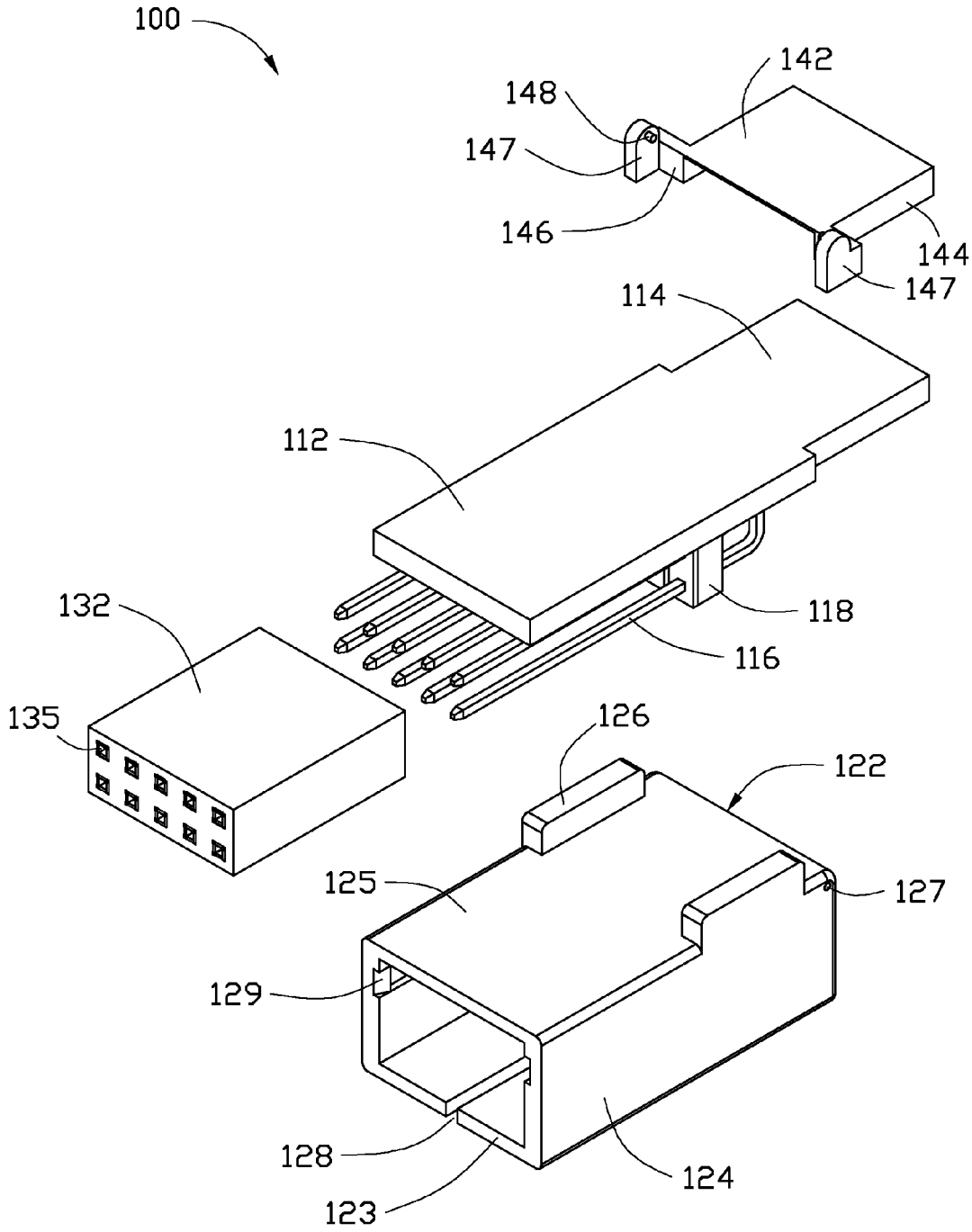
FIG. 3 is an inverted view of FIG. 2.

Referring to FIGS. 2 and 3, an embodiment of a universal serial bus (USB) adapter 100 includes an adapter board 110, a receiving cover 120, a sliding element 130, and a pivoting element 140.

The adapter board 110 includes a rectangular main board 112 and a golden finger board 114 extending from an end of the main board 112. The width of the main board 112 exceeds that of the golden finger board 114. The adapter board 110 further includes two rows of L-shaped parallel signal pins 116 (each row may include five signal pins 116) mounted on the main board 112. The short part of each signal pin 116 is fixed to the main board 112, and the long part of each signal pin 116 is parallel to the main board 112. One row of signal pins 116 adjacent to the golden finger board 114 is taller than the other row of signal pins 116. Extending length of the two rows of signal pins 116, opposite to the golden finger board 114, is the same, and extends beyond the main board 112 by a certain distance. The main board 112 includes a row of insulating block boards 118 extending from the main board 112 and adjacent to the short parts of the signal pins 116 opposite to the golden finger board 114. The long parts of the signal pins 116 extend through the corresponding block boards 118 and are fixed by the block boards 118. The golden finger board 114 includes a number of golden fingers 119, such as four, attached on the golden finger board 114, and correspondingly electrically connected to the signal pins 116. The electrical connection relationship between the golden fingers 119 and the signal pins 116 falls within well-known technologies, and is therefore not described here.

The sliding element 130 includes a rectangular main body 132 of the same width as the main board 112 and of a length equal to the distance from the distal end of the main board 112 opposite to the golden finger board 114 to the block boards 118. The main body 132 defines a number of through grooves 135 corresponding to the signal pins 116, in the through grooves 135 extending through opposite end walls 134 which have the same width with the main board 112, of the main body 132. A guidepost 137 extends from a middle of an end of a top 136 of the main body 132, adjacent to and perpendicular to the sidewall 134 facing the block boards 118. A contact portion 138 extends from a top of the guidepost 137, impelling the sliding element 130. The extending length of the two rows of signal pins 116 relative to the main board 112 is less than the length of the main body 132.

The receiving cover 120 is a rectangular frame and includes a received board 122 and a top board 123 extending from a top of the received board 122, two sideboards 124 extending from opposite sides of the received board 122, and a bottom board 125 extending from a bottom of the received board 122. A distance between the sideboards 124 is equal to the width of the main board 112. A distance between the top board 123 and the bottom board 125 is equaling or exceeding a thickness sum of the sliding element 130 and the main board 112. The received board 122 defines a through hole 121 adjacent to the bottom board 125, through which the golden finger board 114 extends. The sideboards 123 each define a pivot hole 127 in the corner adjacent to the received board 122 and the bottom board 125. Two retaining portions 126 extend from opposite sides of the bottom board 125, adjacent to the received board 122 and the corresponding sideboard 124. The top board 123 defines a long through slot 128 in the middle of the top board 123 and away from the received board 122, corresponding to the guidepost 137. Through slot 128 is of the same width as the guidepost 137. Through slot 128 is the same length as main body 132. The guidepost 137 is of a height equaling or exceeding the thickness of the top board 123. The sideboards 124 each define a slide slot 129 in an inner surface of the sideboard 124, corresponding to opposite sides of the main board 112.

The pivoting element 140 includes a board 142 of a size the same as golden finger board 114. Two retaining sidewalls 144 extend from opposite sides of the board 142, corresponding to the retaining portions 126 of the receiving cover 120. Two extending portions 146 extend from rear ends of the retaining sidewalls 144, and two pivoting portions 147 extend from distal ends of the extending portions 146. A pivoting pin 148 extends from each extending portion 146 towards the other extending portion 146. A distance between the pivoting portions 147 is equal to the width of the receiving cover 120. A distance between outer surfaces of the retaining sidewalls 144 is equal to the distance between the retaining portions 126 of the receiving cover 120. A distance between inner surfaces of the retaining sidewalls 144 is equal to the width of the golden finger board 114.

Figure 4:
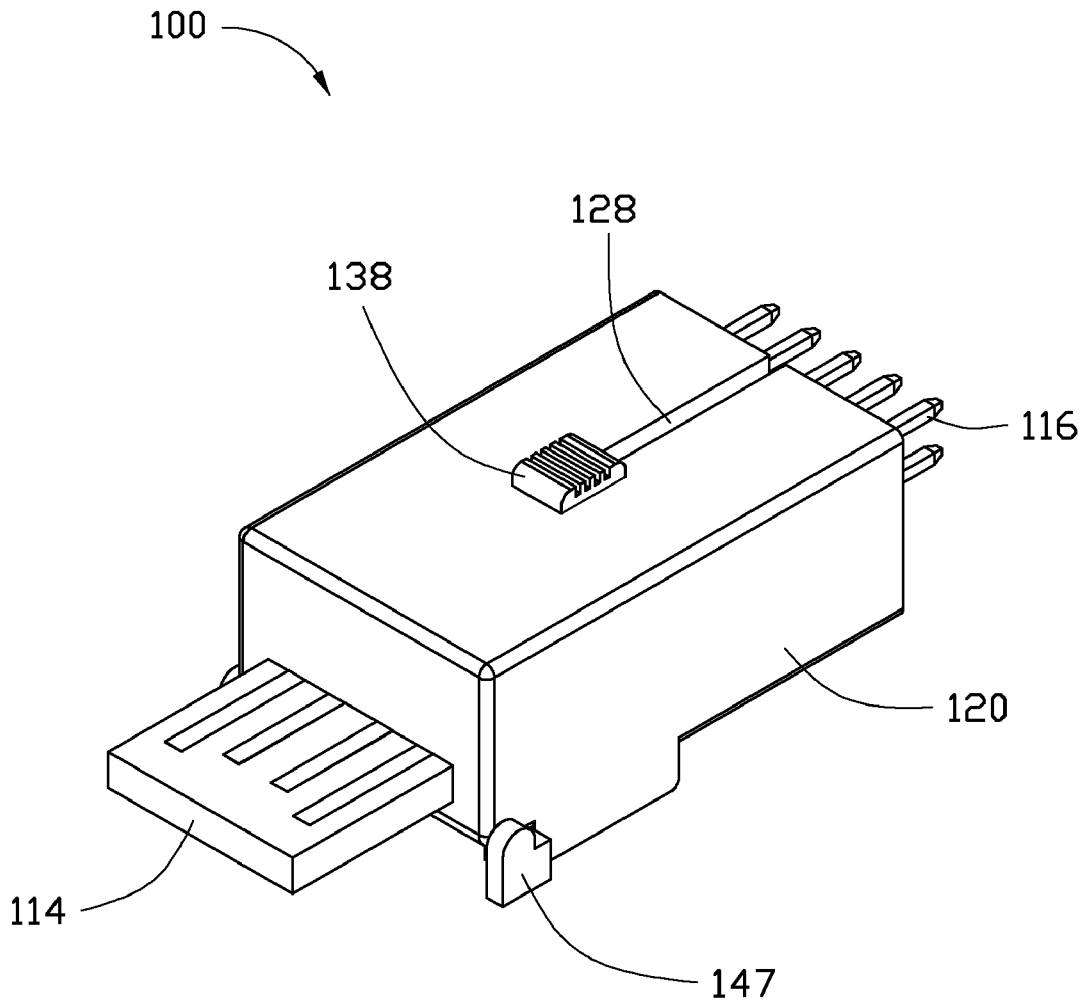
FIG. 4 is an assembled view of the USB adapter of FIG. 2, in a first state.
Figure 5:
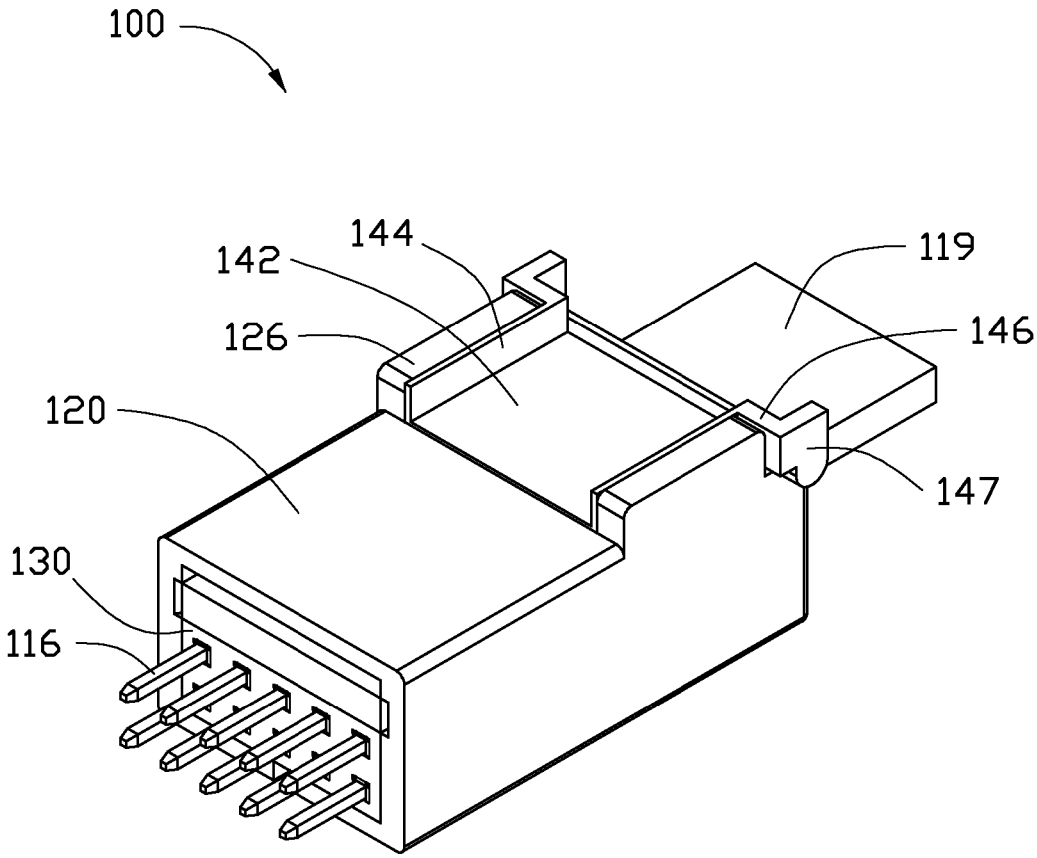
FIG. 5 is an inverted view of FIG. 4.

Referring to FIGS. 4-5, in assembly, the adapter board 110 is received in the receiving cover 120, with the main board 112 received in the corresponding sliding slots 129 of the receiving cover 120 and the golden finger board 114 exposed outside of the receiving cover 120 through the through hole 121. The sliding element 130 is received in the receiving cover 120, with the signal pins 116 of the adapter board 110 extending through the corresponding through grooves 135 of the sliding element 130 and the guidepost 137 received in the through slot 128. The contact portion 138 extends beyond the receiving cover 120. When the contact portion 138 is impelled and moves the guidepost 137 to the close end of the through slot 128 adjacent to the received board 122, the sliding element 130 is completely received in the receiving cover 120. The pivoting pins 148 of the pivoting element 140 are rotatably received in the corresponding pivot holes 127 of the receiving cover 120, with the retaining sidewalls 144 sandwiched between the retaining portions 126 of the receiving cover 120. In this first state, the signal pins 116 connect to a female USB header, and the golden finger board 114 connects to a male USB connector.

Figure 6:
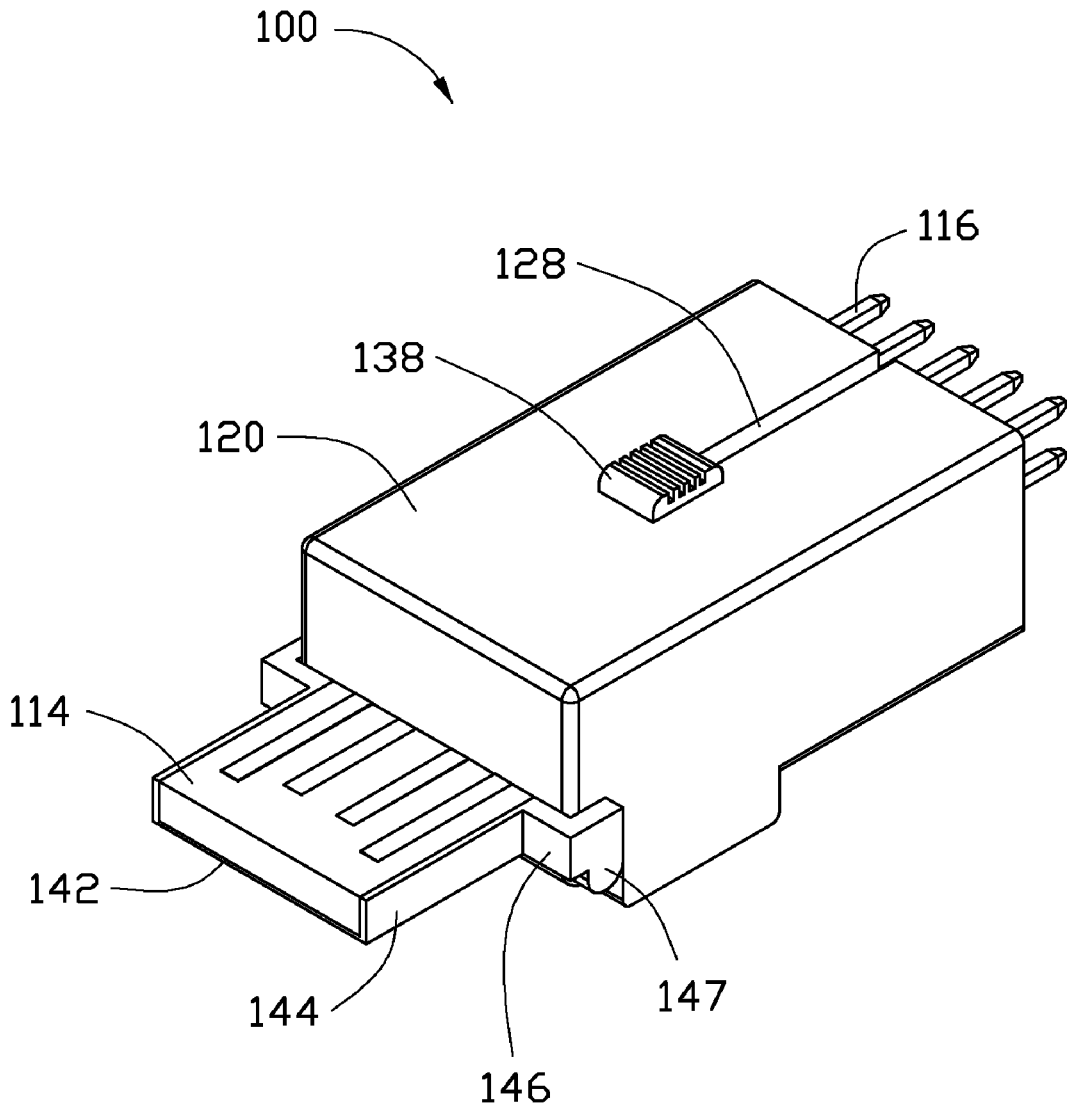
FIG. 6 is an assembled view of the USB adapter of FIG. 2, in a second state.
Figure 7:
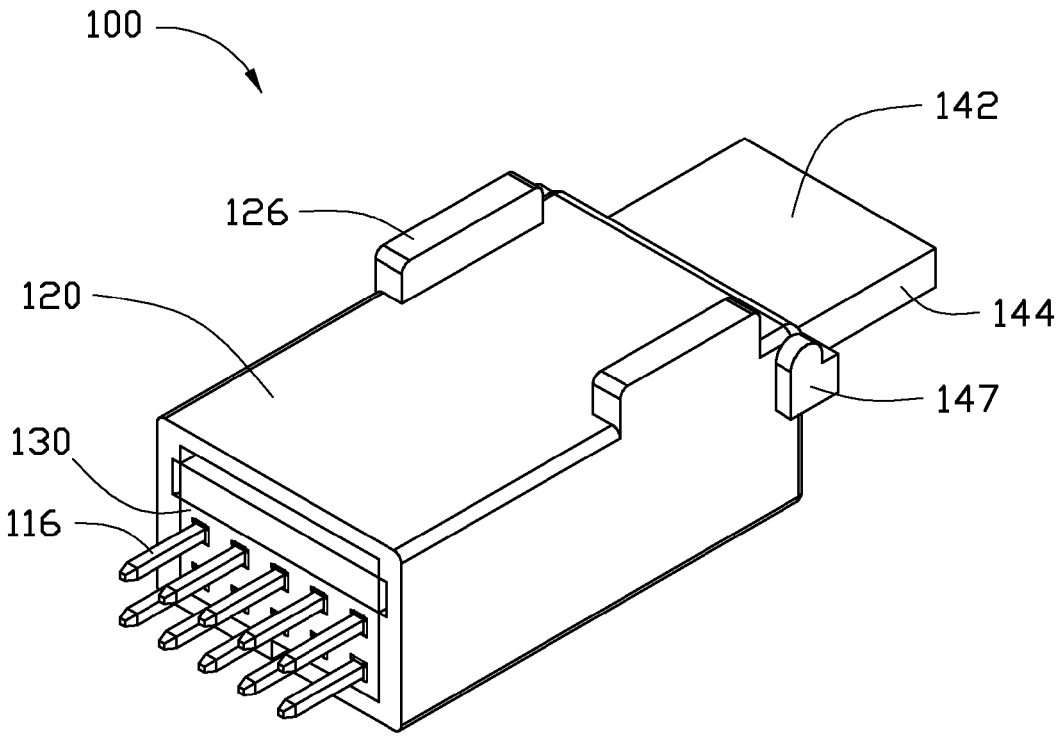
FIG. 7 is an inverted view of FIG. 6.

Referring to FIGS. 6-7, the pivoting element 140 pivots on the pivoting pins 148, until the retaining sidewalls 144 sandwich the golden finger board 114. In this second state, the signal pins 116 connect to a female USB header, and the golden finger board 114 together with the pivoting element 140 connects to a female USB connector.

Figure 8:
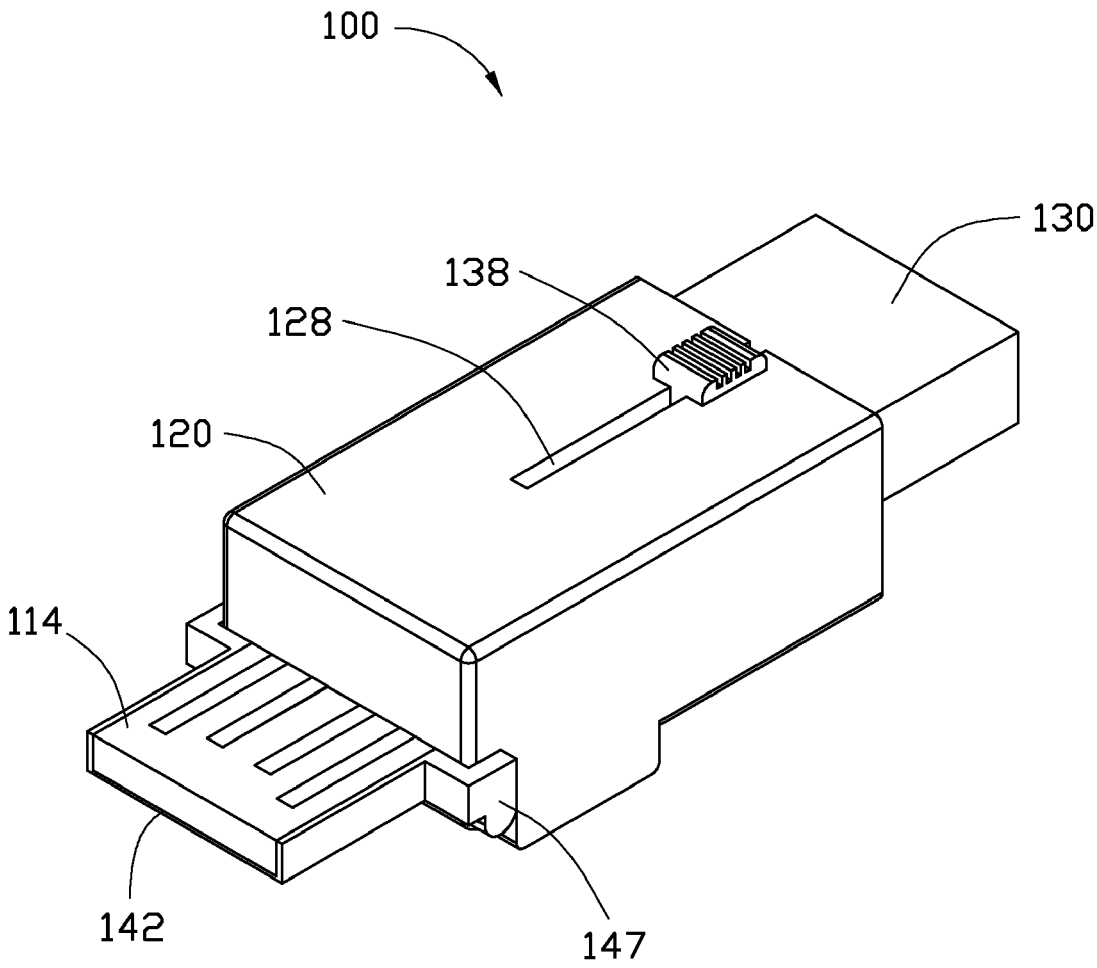
FIG. 8 is an assembled view of the USB adapter of FIG. 2, in a third state.

Referring to FIG. 8, the contact portion 138 is impelled and moves the guidepost 137 to the open end of the through slot 128 opposite to the received board 122, with the sliding element 130 partially exposed outside of the receiving cover 120, and the retaining sidewalls 144 sandwich the golden finger board 114. In this third state, the sliding element 130 together with the signal pins 116 connects to a male USB header, and the golden finger board 114 together with the pivoting element 140 connects to a female USB connector.

Figure 9:
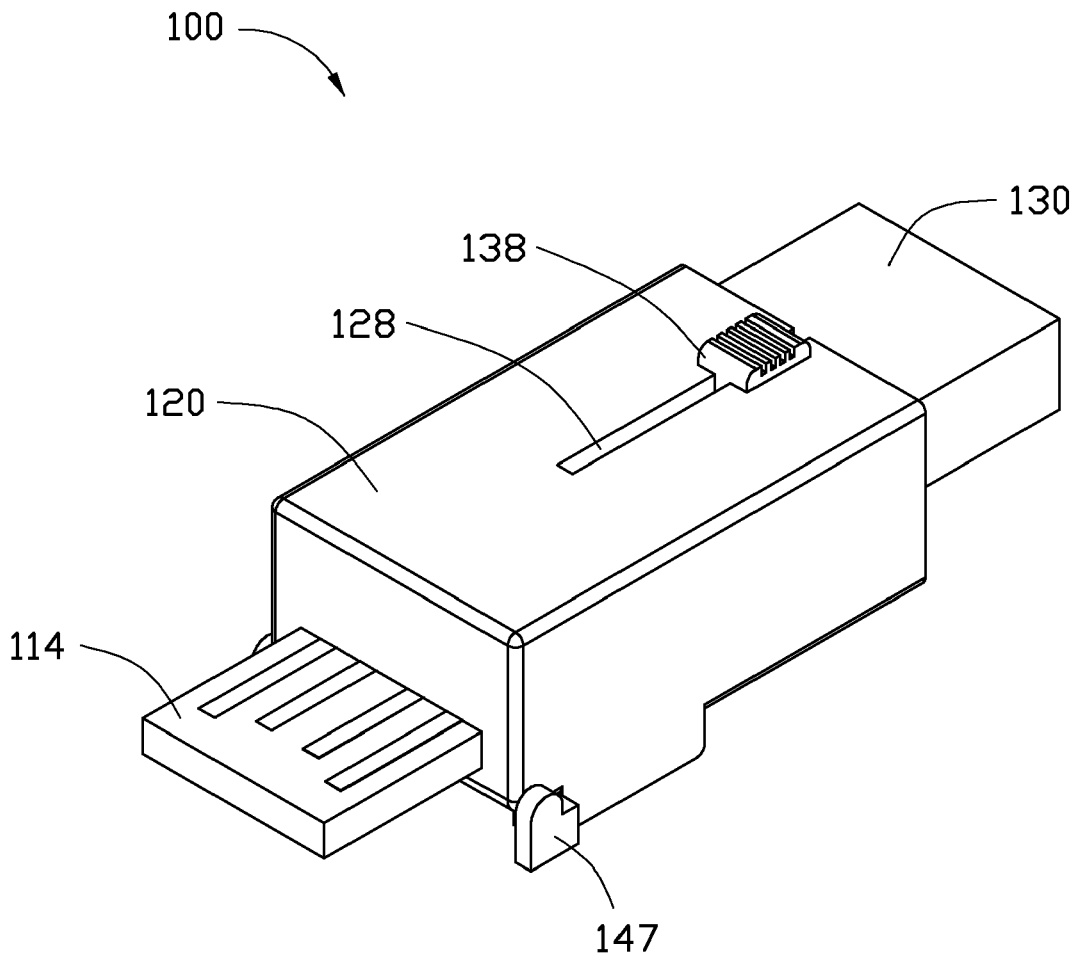
FIG. 9 is an assembled view of the USB adapter of FIG. 2, in a fourth state.

Referring to FIG. 9, the contact portion 138 is impelled and moves the guidepost 137 to the close end of the through slot 128, and the pivoting element 140 pivots, with the retaining sidewalls 144 sandwiched between the retaining portions 126 of the receiving cover 120. In this fourth state, the sliding element 130 together with the signal pins 116 connects to a male USB header, and the golden finger board 114 connects to a male USB connector.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A universal serial bus (USB) adapter comprising:

an adapter board comprising a main board, a golden finger board extending from a first end of the main board, and a plurality of signal pins; wherein a first part of each signal pin is fixed to the main board, and a second part of the signal pin is substantially parallel to the main body, the golden finger board comprises a plurality of golden pad fingers attached on the golden finger board and correspondingly electrically connected to the plurality of signal pins;

a sliding element comprising a main body through which the second parts of the plurality of signal pins slidably extend therein through grooves of an end wall of the sliding element;

a receiving cover receiving the main board of the adapter board and the main body of the sliding element, with the golden finger board exposed outside of the receiving cover; and a pivoting element comprising a board being a same size as the golden finger board and rotatably mounted to a bottom end of the receiving cover;

wherein the plurality of signal pins is operable to be connected to a first USB interface in response to the main body of the sliding element being slided to be completely received in the receiving cover;

wherein the main body of the sliding element together with the plurality of signal pins is operable to be connected to a second USB interface in response to the main body sliding being partially received in the receiving cover;

wherein the golden finger board together with pivoting element is operable to be connected to a third USB interface in response to the board of the pivoting element being rotated to be located against and below the golden finger board;

wherein the golden finger board is operable to be connected to a fourth USB interface in response to the board of the pivoting element being rotated to move away from the golden finger board; and wherein the first to fourth USB interfaces are respectively a female USB header, a male USB header, a female USB connector, and a male USB connector.

2. The USB adapter of claim 1, wherein the main board of the adapter board is rectangular, a width of the golden finger board is less than a width of the main board, the plurality of signal pins is substantially L-shaped and arranged in two rows, the first part is a short part of each signal pin which is fixed to the main board, the second part is a long part of each signal pin which is substantially parallel to the main board, an upper row of the plurality of signal pins which is adjacent to the golden finger board is higher than a lower row of the plurality of signal pins, an extending length of the plurality of signal pins, opposite to the golden finger board, is the same and exceeds a second end of the main board opposite to the first end a first distance, the main board comprises a row of block boards extending from the main board and adjacent to the short sides of the plurality of signal pins opposite to the golden finger board, the long parts of the plurality of signal pins extend through and are fixed to the block boards.

3. The USB adapter of claim 2, wherein the main body of the sliding element is rectangular-shaped, a width of the main body is equal to the width of the main board of the adapter board, a length of the main body is equal to a distance from the second end of the main board to the block boards, the main body horizontally defines a plurality of through grooves corresponding to the plurality of signal pins, a guide post extends from a middle of a top of the main body, a pushing button extends from a top of the guidepost, the first distance of the plurality of signal pins exceeding the second end of the main board is less than the horizontal length of the main body, the main body is slidably mounted to the plurality of signal pins through the plurality of signal pins slidably extending through the plurality of through grooves.

4. The USB adapter of claim 3, wherein the receiving cover is a rectangular frame and comprises an received board and a top board substantially extending from a top of the received board, two sideboards substantially extending from opposite sides of the received board, and a bottom board substantially extending from a bottom of the received board, a distance between the sideboards is equal to the width of the main board, a distance between the top board and the bottom board is equaling or exceeding a thickness sum of the sliding element and the main board, the received board defines a through hole adjacent to the bottom board through which the golden finger board extends to be exposed outside of the receiving cover, the sideboards each define a pivot hole in the corner adjacent to the received board and the bottom board to rotatably mounting the pivoting element, two retaining portions extend from opposite sides of the bottom board and adjacent to the received board to sandwich the pivoting element, the top board defines a through slot in the middle of the top board and far away from the received board to receive the guide post, a width of the through slot is equal to a width of the guidepost, a length of the through slot is equal to the length of the main body, a highness of the guide post is equaling or exceeding the thickness of the top board, an inner surface of each sideboard defines a sliding slot to receive a corresponding side of the main board.

5. The USB adapter of claim 4, wherein two retaining sidewalls extend from opposite sides of the board of the pivoting element corresponding to the retaining portions, two extending portions extend from rear ends of the retaining sidewalls, and two pivoting portions extend from the extending portions, a pivoting pin extends from each extending portion towards the other extending portion, to be rotatably engaged in a corresponding pivot hole of the receiving cover, a distance between the pivoting portions is equal to a width of the receiving cover, a distance between outer surfaces of the retaining sidewalls is equal to a distance between the retaining portions, a distance between inner surfaces of the retaining sidewalls is equal to the width of the golden finger board.

* * * * *